US011049647B2

(12) United States Patent
Navarro et al.

(10) Patent No.: US 11,049,647 B2
(45) Date of Patent: Jun. 29, 2021

(54) MOLDED TAP CHANGER ASSEMBLIES AND METHODS FOR DRY-TYPE TRANSFORMERS

(71) Applicants: Siemens Aktiengesellschaft, Munich (DE); Hainan Jinpan Smart Technology Co., Ltd., Hainan (CN)

(72) Inventors: Martin Alsina Navarro, Sao Paulo (BR); Andre Luiz Moreno, Varzea Paulista (BR); Yaoqiang Wang, Hubei (CN); Yuqian Zhang, Hubei (CN); Xiaofeng Lu, Hubei (CN)

(73) Assignees: SIEMENS ENERGY GLOBAL GMBH & CO. KG, Munich (DE); HAINAN JINPAN SMART TECHNOLOGY CO. LTD, Haikou (CN)

( * ) Notice: Subject to any disclaimer, the term of this patent is extended or adjusted under 35 U.S.C. 154(b) by 0 days.

(21) Appl. No.: 17/046,372

(22) PCT Filed: Apr. 23, 2018

(86) PCT No.: PCT/CN2018/084069

§ 371 (c)(1),
(2) Date: Oct. 9, 2020

(87) PCT Pub. No.: WO2019/204963

PCT Pub. Date: Oct. 31, 2019

(65) Prior Publication Data

US 2021/0057147 A1 Feb. 25, 2021

(51) Int. Cl.
*H01F 27/02* (2006.01)
*H01F 29/02* (2006.01)
(Continued)

(52) U.S. Cl.
CPC ..... *H01F 29/025* (2013.01); *H01F 27/02* (2013.01); *H01F 27/022* (2013.01);
(Continued)

(58) Field of Classification Search
CPC ..... H01F 29/00; H01F 29/02; H01F 29/025; H01F 27/363; H01F 27/02; H01F 29/022;
(Continued)

(56) References Cited

U.S. PATENT DOCUMENTS 3,617,966 A * 11/1971 Trench ..... H01F 27/40 336/61
3,943,433 A * 3/1976 Hermstein ..... H01F 38/30 323/358
(Continued)

FOREIGN PATENT DOCUMENTS

CN 101299382 A 11/2008
CN 103119668 A 5/2013

OTHER PUBLICATIONS

PCT Written Opinion of the International Searching Authority dated Jan. 22, 2019 corresponding to PCT Application No. PCT/CN2018/084069 filed Apr. 23, 2018.

*Primary Examiner* — Tuyen T Nguyen

(57) ABSTRACT

A tap changer assembly of a dry-type transformer. The tap changer assembly includes a first molding including multiple taps, a semi-conductive coating applied to the first molding, a conductive shield provided overtop some of the semi-conductive coating, a grounding member comprising a ring of bosses interconnected by a grounding conductor connected to the conductive shield, a second molding applied over at least a portion of the conductive shield and the grounding conductor, the second molding forming a molded sealing surface, a conductive cover coupled to the ring of bosses; and a sealing member sealing a space between the molded sealing surface and the conductive
(Continued)

cover. Dry-type transformers and methods of forming a tap changer assembly of a dry-type transformer are provided, as are numerous other aspects.

19 Claims, 9 Drawing Sheets

(51) Int. Cl.
*H01F 27/36* (2006.01)
*H01F 41/02* (2006.01)
*H01F 29/00* (2006.01)

(52) U.S. Cl.
CPC ..... *H01F 27/363* (2020.08); *H01F 29/00* (2013.01); *H01F 29/02* (2013.01); *H01F 41/0246* (2013.01)

(58) Field of Classification Search
CPC ..... H01F 41/0246; H01F 27/36; H01F 2027/329; H01F 27/327
See application file for complete search history.

(56) References Cited

U.S. PATENT DOCUMENTS

| | | | | |
|---|---|---|---|---|
| 4,200,854 | A | 4/1980 | DeLaurentis et al. | |
| 4,504,811 | A | 3/1985 | Stunzi | |
| 5,621,372 | A | 4/1997 | Purohit | |
| 8,212,645 | B2 | 7/2012 | Navarro et al. | |
| 8,614,614 | B2 | 12/2013 | Navarro et al. | |
| 9,355,772 | B2 | 5/2016 | Navarro | |
| 2014/0034464 | A1* | 2/2014 | Larsson ..... | H01H 9/0005 200/16 R |

* cited by examiner

MOLDED TAP CHANGER ASSEMBLIES AND METHODS FOR DRY-TYPE TRANSFORMERS

FIELD

This application relates to transformers used for electric power distribution, and more particularly to tap changer assemblies and methods for dry-type transformers.

BACKGROUND

Transformers are employed to increase or decrease voltage levels during electrical power distribution. To transmit electrical power over a long distance, a transformer may be used to raise the voltage and reduce the current of the power being transmitted. A reduced current level reduces resistive power losses from the electrical cables used to transmit the power. When the power is to be consumed, a transformer may be employed to reduce the voltage and increase the current to a level specified by the end user.

One type of transformer that may be employed is a submersible dry-type transformer described, for example, in U.S. Pat. No. 8,614,614. Such transformers may be employed underground, in underground sewer systems, and in submerged environments and thus may be designed to withstand harsh environments such as water exposure, humidity, pollution, and the like. Improved assemblies and methods for submersible and other dry-type transformers are desired.

SUMMARY

In some embodiments, a tap changer assembly of a dry-type transformer is provided. The tap changer assembly includes a first molding including multiple taps; a semi-conductive coating applied to an outer surface of the first molding; a conductive shield provided in contact with the semi-conductive coating; a grounding member comprising a ring of bosses interconnected by a grounding conductor; a second molding applied over at least a portion of the conductive shield and the grounding conductor, the second molding including a molded sealing surface; a conductive cover coupled to the ring of bosses; and a sealing member sealing between the molded sealing surface and the conductive cover.

In some embodiments, a dry-type transformer is provided. The dry-type transformer includes a coil assembly having an inner coil, an outer coil, and a tap changer assembly having multiple taps configured to allow voltage adjustments across the outer coil, the tap changer assembly, comprising: a first molding including the multiple taps; a semi-conductive coating applied to an outer surface of the first molding; a conductive shield provided in contact with the semi-conductive coating; a grounding member comprising a ring of bosses interconnected by a grounding conductor; a second molding applied over at least a portion of the conductive shield and the grounding conductor, the second molding including a molded sealing surface; a conductive cover coupled to the ring of bosses; and a sealing member sealing between the molded sealing surface and the conductive cover.

In some embodiments, a method of forming a tap changer assembly of a dry-type transformer is provided. The method includes forming a first molding including the multiple taps; applying a semi-conductive coating to the first molding; providing a conductive shield overtop some of the semi-conductive coating; providing a grounding member comprising a ring of bosses interconnected by a grounding conductor; and applying a second molding over at least a portion of the conductive shield and the grounding conductor, the second molding including a molded sealing surface.

Still other aspects, features, and advantages of this disclosure may be readily apparent from the following detailed description, which illustrates by a number of example embodiments. This disclosure may also be capable of other and different embodiments, and its several details may be modified in various respects. Accordingly, the drawings and descriptions are to be regarded as illustrative in nature, and not as restrictive.

BRIEF DESCRIPTION OF THE DRAWINGS

The drawings, described below, are for illustrative purposes only and are not necessarily drawn to scale. The drawings are not intended to limit the scope of the invention in any way. Wherever possible, the same or like reference numbers are used throughout the drawings to refer to the same or like parts.

DETAILED DESCRIPTION

As mentioned above, submersible dry-type transformers may be employed underground, submerged, and/or in other environments that may expose the transformer components to water, humidity, pollutants, etc. Such dry-type transformers are often connected to deliver single or multiple phases of electrical power, such as 2-phase, 3-phase, for example. Common implementations are 3-phase configurations.

Such dry-type transformers can include for each high voltage coil thereof a tap changer such as is described in U.S. Pat. No. 9,355,772 entitled "Transformer Provided With A Taps Panel, An Electric Insulation Method For Taps Panel Of A Dry Distribution Transformer, And A Taps Panel For A Dry Distribution Transformer."

Conventional tap changer configurations for submersible dry-type transformers are made on a front side of the transformers. For example, each high voltage coil of a transformer may have multiple taps that allow for adjustments to the voltage across the respective high voltage coils. However, existing implementations utilize expensive components and are prone to corrosion. Improved tap changer assemblies that offer improved corrosion resistance, sealing capability, and lower cost are desired.

In accordance with one or more embodiments described herein, improved tap changer assemblies such as for submersible dry-type transformers are provided. In some embodiments, the tap changer assembly includes a first molding including the taps molded therein, a semi-conductive coating applied to surfaces of the first molding, and a conductive shield provided overtop of portions of the semi-conductive coating, a grounding member having a grounding conductor and coupled threaded bosses (threaded inserts), and a second molding encapsulating the grounding member and forming a molded sealing surface. A sealing member is seated between the molded sealing surface and a conductive cover to seal the tap changer cavity. In some embodiments, a sealing surface enabling sealing between the conductive cover and the second molding comprises a molded O-ring groove. Other embodiments provide the second molding as a separately-molded member that is mechanically fastened to the first molding.

The above-described configurations provide an inexpensive, yet robust tap changer assembly construction capable of being readily manufactured and sealed. Thus, the dry-type transformer can be less expensive to manufacture, and can be less susceptible to corrosion and may offer improved sealing of the taps cavity.

Figure 1A:
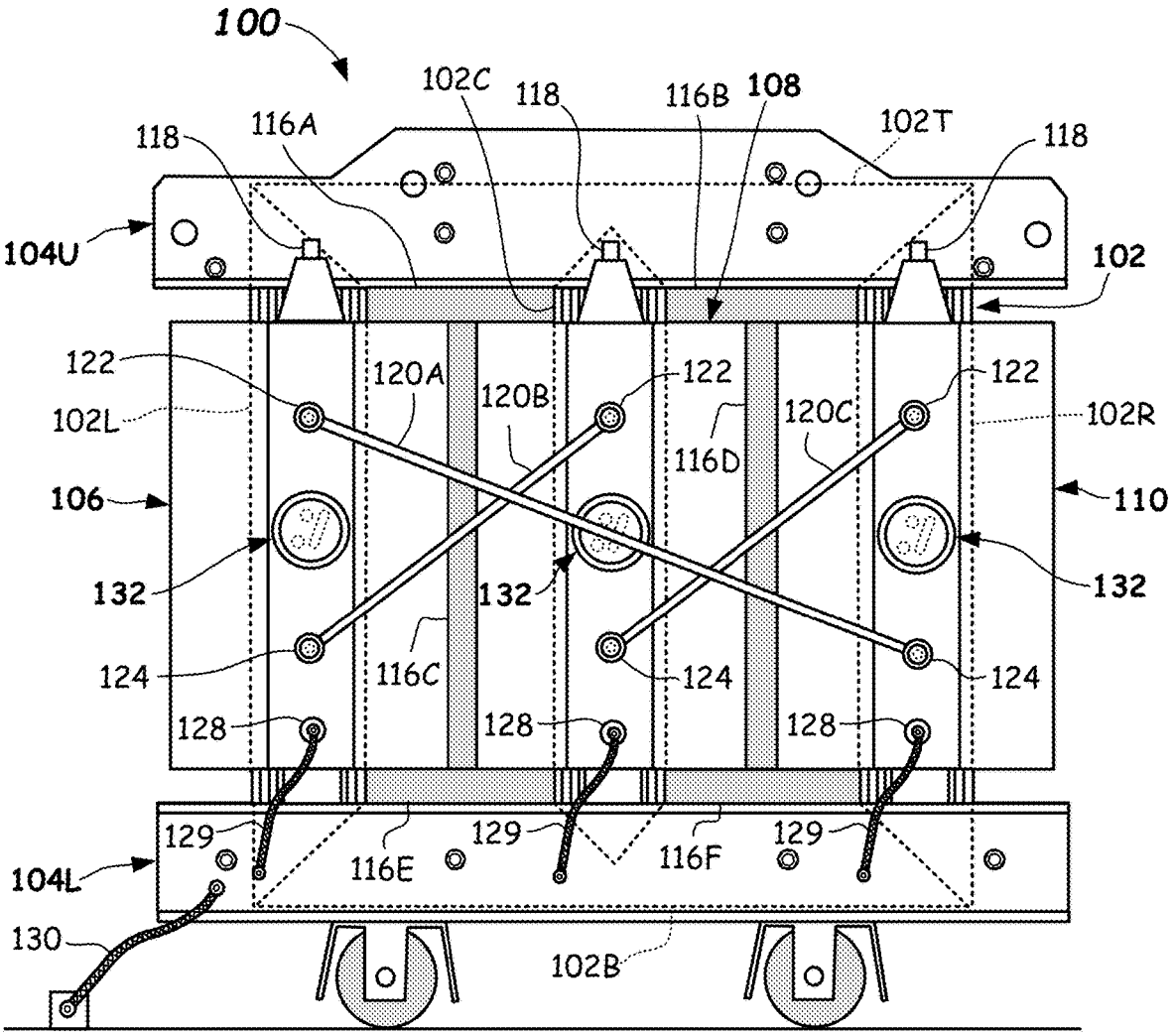
FIG. 1A illustrates a front plan view of a submersible dry-type transformer in accordance with embodiments provided herein.

FIG. 1A is a front plan view of a dry-type transformer 100 in accordance with embodiments provided herein. The dry-type transformer 100 shown is a three-phase transformer, but in other embodiments, transformers with different number of phases may be employed (e.g., one or two phases). Dry-type transformer as used herein means a transformer that includes high and low voltage coils that are not submerged in an oil bath contained within an enclosure. Such dry-type transformers 100 have significant advantages, in that they do not utilize oil and are thus exposed directly to the environment such that the can run cooler via cooling by air or water (when submerged).

By way of example, the dry-type transformer 100 can include a core assembly 102 mounted between an upper frame portion 104U and lower frame portion 104L. Insulating sheets may be provided to insulate the sides of the core assembly 102 from the respective upper and lower frames 104U, 104L. Core assembly 102 may be made up of multiple laminations of a magnetic material. Example magnetic materials include iron, steel, amorphous steel or other amorphous magnetically permeable metals, silicon-steel alloy, carbonyl iron, ferrite ceramics, and more particularly laminated layers of one or more of the above materials, or the like. In some embodiments, laminated ferromagnetic metal materials having high cobalt content can be used. Other suitable magnetic materials can be used.

As shown, core assembly 102 can include multiple interconnected pieces, and can include vertical core columns 102L, 102C, and 102R. Vertical core columns 102L, 102C, and 102R can be assembled with top and bottom core members 102T, 102B. Construction may include step-laps between respective components of the core assembly 102. Construction of the core assembly 102 can be as is shown in U.S. Pat. No. 4,200,854 or 8,212,645, for example. Other configurations of the core assembly 102 can be used. In some embodiments, within transformer 100, each core column 102L, 102C, and 102R can be surrounded by a coil assembly, namely coil assemblies 106, 108, 110.

Figure 1B:
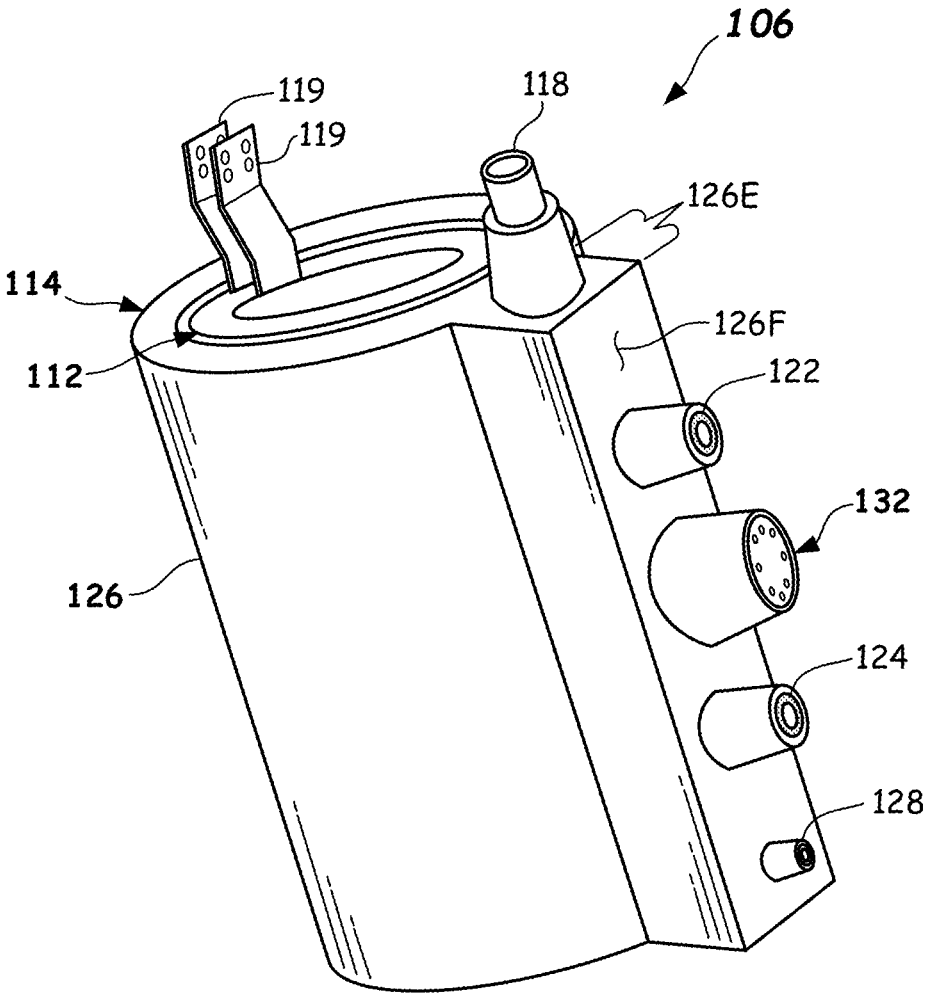
FIG. 1B illustrates a perspective view of a coil assembly including a tap changer assembly in accordance with embodiments provided herein.

FIG. 1B illustrates a perspective view of coil assembly 106. Coil assembly 106 is shown and described herein by way of example, and coil assemblies 108, 110 can be identical or substantially identical thereto. The coil assembly 106 includes a low-voltage inner coil 112 and a high-voltage outer coil 114, which may be concentric with the low-voltage inner coil 112. Low-voltage inner coil 112 may be electrically isolated from the core assembly 102 and also from the high-voltage outer coil 114. For example, low-voltage inner coil 112 may be surrounded by an insulating material such as a molded resin. Likewise, high-voltage outer coils 114 may include a multi-stage insulating material (e.g., resin) provided in multiple sequential molding processes, as will be described fully herein. Example insulating materials can include any suitable solid insulation, such as an epoxy, polyurethane, polyester, silicone, and the like.

Referring again to FIG. 1A, the coil assemblies 106, 108, 110 and core assembly 102 can be separated by insulating sheets 116A-116F and others) as described in U.S. Pat. No. 8,614,614 entitled "Submersible Dry Transformer." Insulating sheets 116A-116F and others (not shown) may be any suitable insulation material and collectively operate to seal the plane of a core window of the core assembly 102 to prevent a loop of water from being formed when submerged. Insulating sheets are also are included between the low-voltage inner coil 112 and a high-voltage outer coil 114, and between the core columns 102L, 102C, 102R and respective low-voltage inner coil 112 within the core window.

Figure 2A:
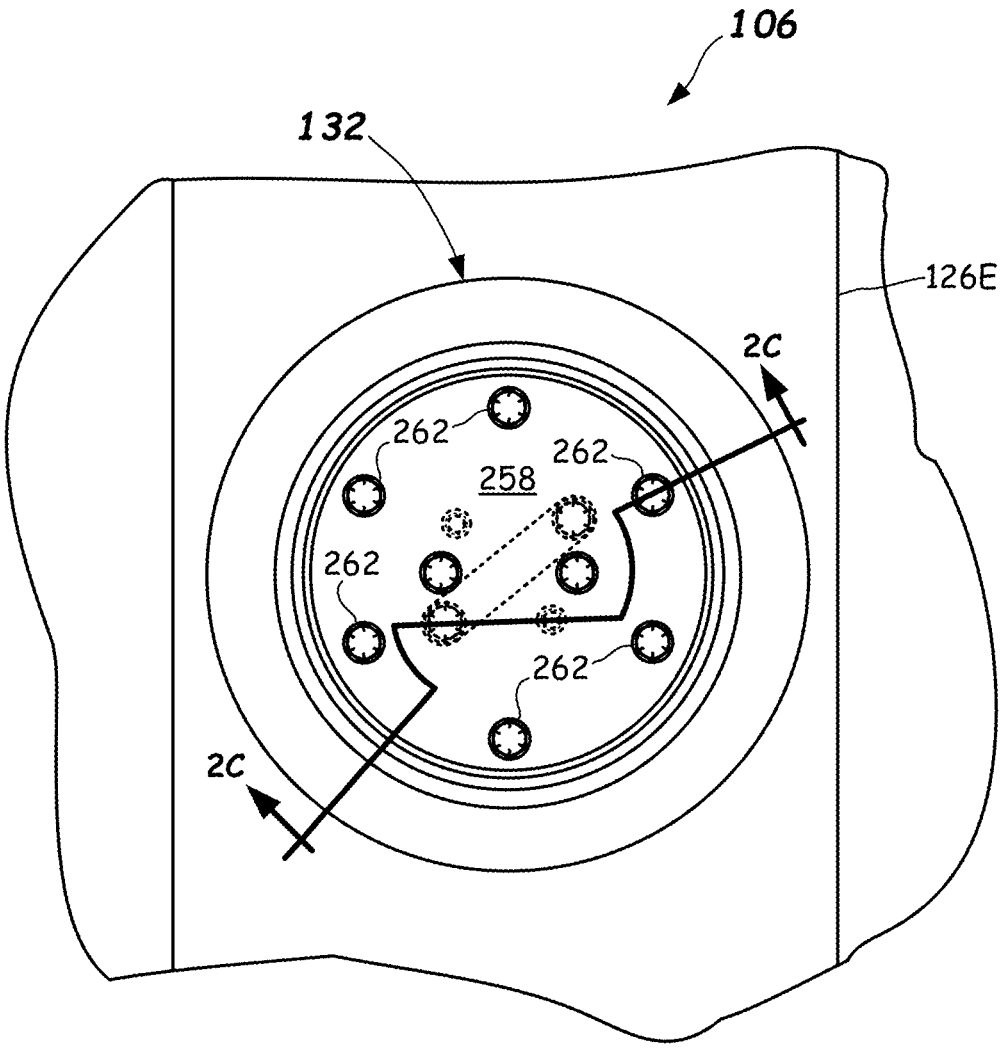
FIG. 2A illustrates a front plan view of a tap changer assembly with a conductive cover installed in accordance with embodiments provided herein.
Figure 2B:
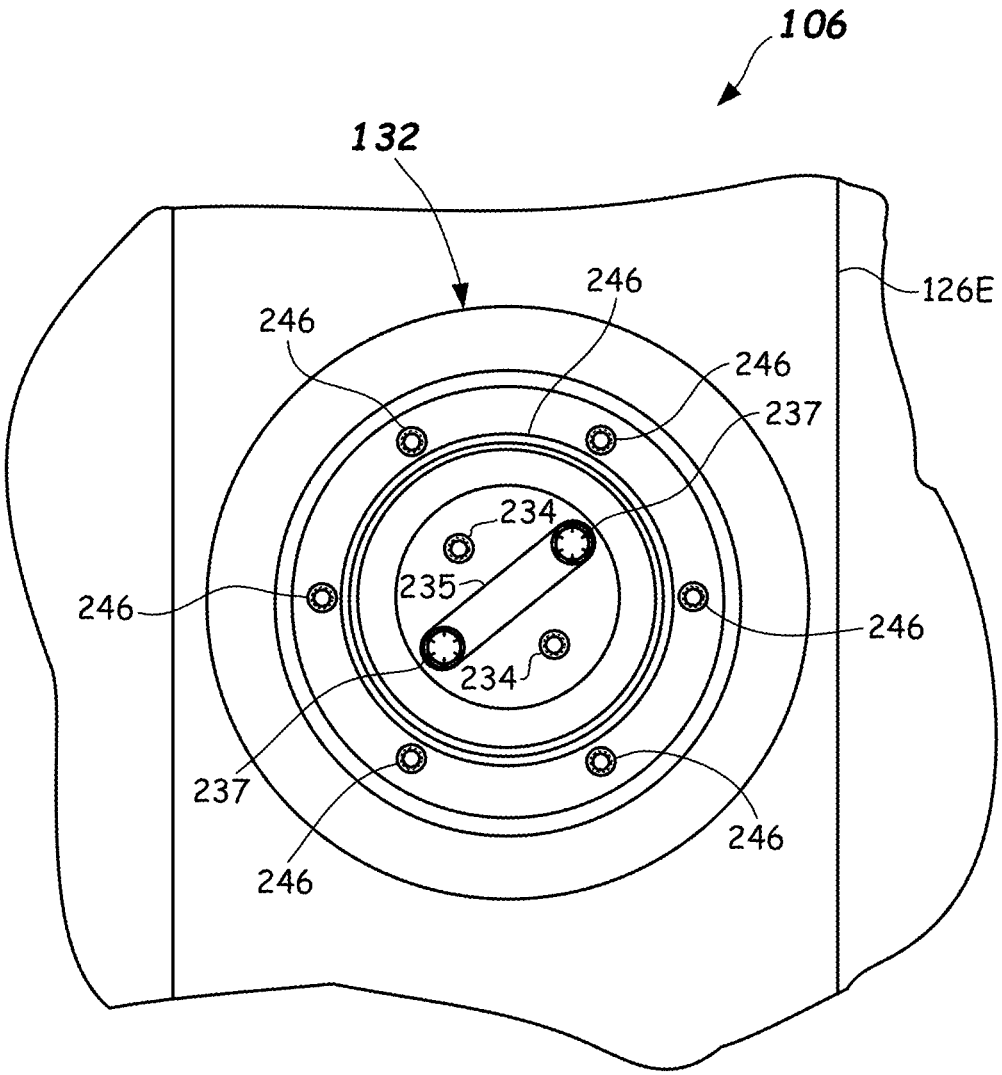
FIG. 2B illustrates a front plan view of a tap changer assembly with the conductive cover removed in accordance with embodiments provided herein.
Figure 2C:
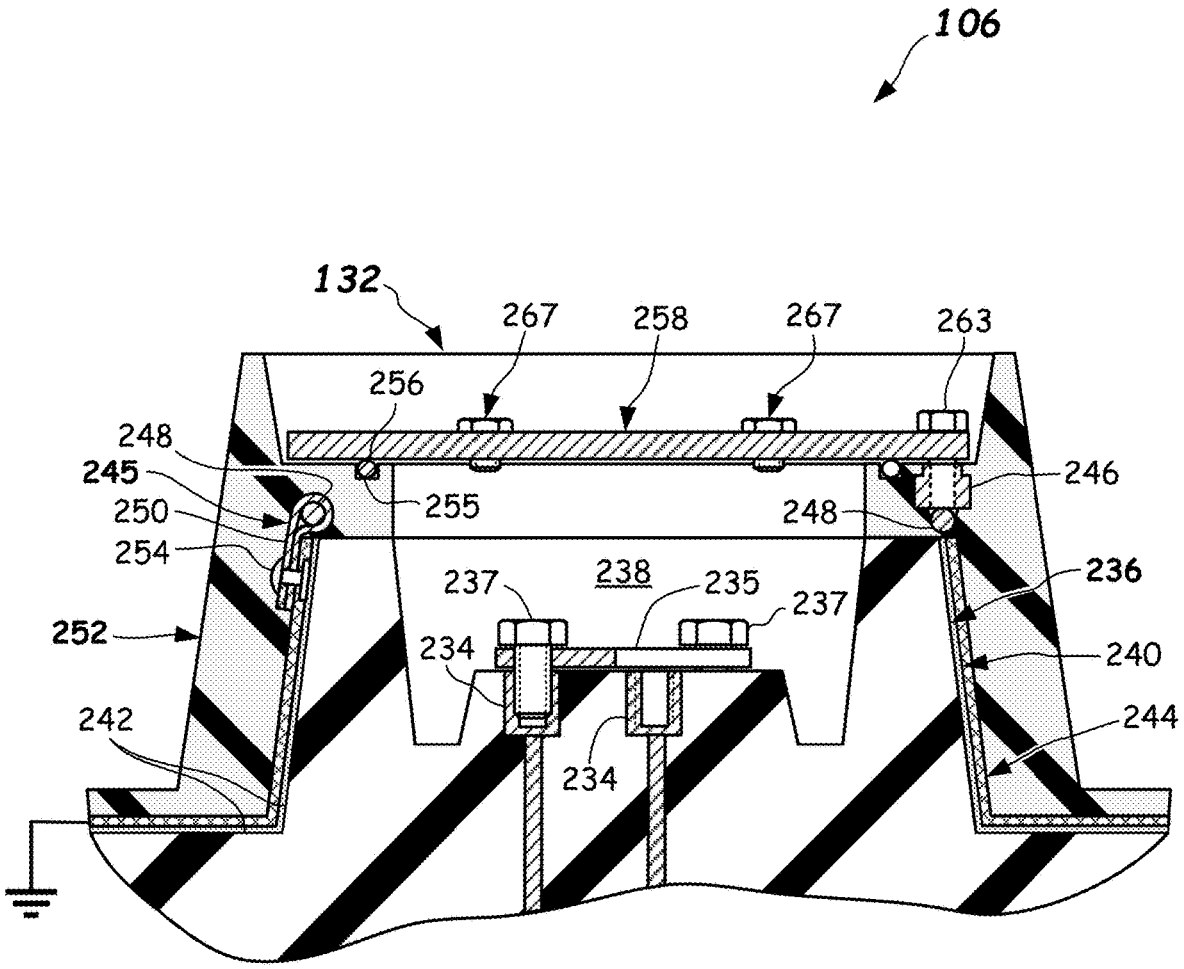
FIG. 2C illustrates a side cross-sectioned view of a tap changer assembly taken along section lines 2C-2C in FIG. 2A in accordance with embodiments provided herein.

Referring again to FIG. 1A, each of the coil assemblies 106, 108, 110 of the transformer 100 can be provided with high voltage terminals 118 that can be positioned at a top front of the respective coil assemblies 106, 108, 110. Low voltage terminals 119 of the low voltage inner coil 112 (FIG. 1B) can be provided on a back side of the coil assemblies 106, 108, 110. For example, as best shown in FIG. 2C, the high voltage terminals 118 can be located on a top front of a columnar front extension 126E of the coil housing 126 and the low voltage terminals 119 can be located on a rear part of the low-voltage inner coil 112. However, the high voltage terminals 118 and low voltage terminals 119 could be located elsewhere. The high voltage terminals 118 provide electrical power connections to the high-voltage outer coils 114 of the respective coil assemblies 106, 108, 110. Connectors (not shown), such as sealed plug-in connectors, may be provided to facilitate sealed connection of high voltage terminals 118 to electrical cables (not shown). Wye connections (not shown) or the like may be made with low voltage terminals 119. Other suitable sealed connections are possible.

As best shown in FIGS. 1A and 1C, the transformer 100 can also include delta connections 120A, 120B, and 120C between the respective high-voltage outer coils 114 of the coil assemblies 106, 108, 110. Delta connections 120A, 120B, 120C may comprise shielded cables, for example. Each of the delta connections 120A, 120B, 120C can be made to an upper delta terminal 122 and a lower delta terminal 124 of the high-voltage outer coil 114 of each of the coil assemblies 106, 108, 110, as shown. The electrical connections can be sealed connections. The upper delta terminal 122 and lower delta terminal 124 can extend horizontally (as shown) from the columnar front extension 126E of the coil housing 126. For example, the upper delta terminal 122 and lower delta terminal 124 can extend outwardly from a front face 126F of the columnar front extension 126E in some embodiments.

The high-voltage outer coil 114 of each of the coil assemblies 106, 108, 110 can include a grounding terminal 128. Grounding conductors 129, such as braided cables can connect between the respective grounding terminals 128 of the high-voltage outer coils 114 and the lower frame 104L, for example. A common grounding strap 130 can attach to the lower frame 104L and can provide an earth ground. Each of the coil assemblies 106, 108, 110 includes an inventive tap changer assembly 132 to be described fully herein.

Additional details regarding conventional construction of submersible dry-type transformers 100 that may be employed in accordance with one or more embodiments provide herein and conventional tap changers are described in previously-mentioned U.S. Pat. Nos. 8,614,614 and 9,355,772, which are hereby incorporated by reference herein in their entirety for all purposes.

In an aspect with broad applicability to transformers, an improved tap changer assembly 132 is provided. A first example embodiment of a tap changer assembly 132 and components thereof is shown and described with reference to FIGS. 2A-2E herein. The tap changer assembly 132 may be included on each of the high-voltage outer coils 114. For example, the tap changer assembly 132 can be provided as an extension from a front of the high-voltage outer coil 114. More particularly, the tap changer assembly 134 can be, as shown in FIG. 1B, an extension from the columnar front extension 126E, and can be conical in shape.

The tap changer assembly 132 has multiple taps 234 (4 in the present embodiment) configured to allow voltage adjustments (e.g., +/− from a nominal (N) voltage) across the high-voltage outer coil 114. For example, with four taps 234 shown in FIG. 2B, adjustments of +5%, +2.5%, Normal (N), −2.5%, −5% can be made. Other % variations are possible by tapping at different points on the high-voltage outer coil 114. Other numbers of taps 234 are possible, such as 4, 5, 6, or more, thus allowing finer gradations of voltage adjustments. The voltage adjustments can be made via various interconnections between respective pairs of the taps 234 with a bridge 235. The bridge 235 can be a conductive strap, such as a highly-conductive metal (e.g., copper or aluminum, and the like, for example). Other conductive metals can be used. Ends of the bridge 235 may be connected between two selected taps 234 by conductive fasteners 237 (e.g., stainless steel fasteners) to facilitate connection to a location along the coils in the high-voltage outer coil 114.

Figure 4:
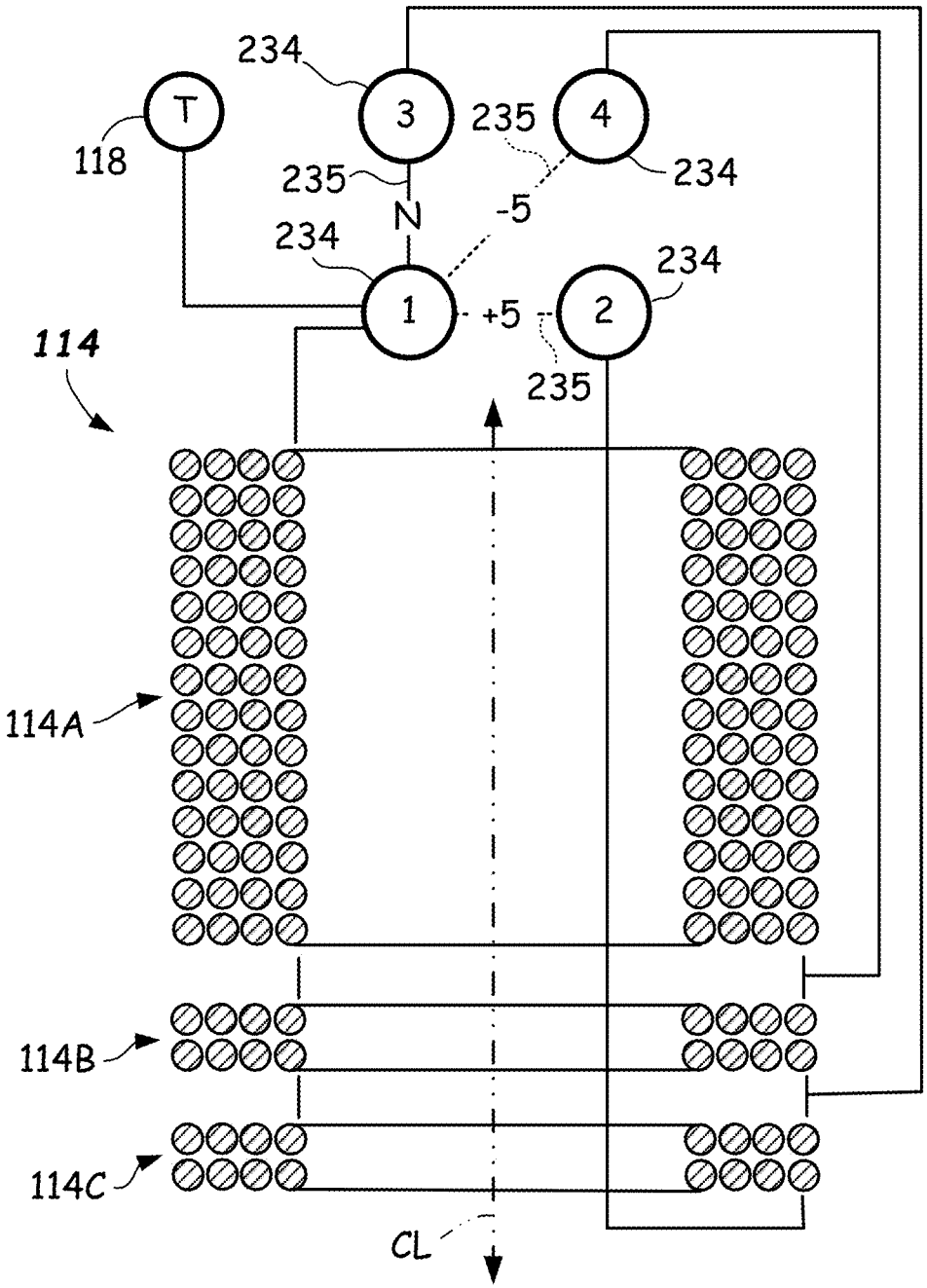
FIG. 4 illustrates a schematic diagram of taps and electrical connections to the outer coil of the transformer made in the tap chamber assembly in accordance with embodiments provided herein.

FIG. 4 illustrates an example schematic diagram of the taps 234 (4 shown) and their connections to the high-voltage outer coil 114. The high-voltage outer coil 114 is shown as a number of coil windings or turns symmetric about a centerline (CL) axis. For illustration purposes, the coil 114 has been split into first portion 114A, second portion 114B, and third portion 114C. Interconnecting across various taps 234 can allow current flow through all or some smaller portion of the high-voltage outer coil 114. For example, coupling tap 1 with tap 3 via bridge 235 (solid line) can provide a nominal (N) voltage across the coil 114 by enabling current flow through first portion 114A and second portion 114B of the high-voltage outer coil 114. Taps 234 used in order to adjust the quantity of windings of the high voltage outer coil 114 to a voltage of the network.

Alternatively, connection of bridge 235 (dotted line) between tap 1 and tap 4 can provide more turns for a lower voltage (e.g., −5% voltage from the nominal (N) voltage) across the high-voltage outer coil 114 by enabling current flow only through first portion 114A of the high-voltage outer coil 114. In another option, connection of the bridge 235 (dotted line) between tap 1 and tap 2 can provide the turns for a higher voltage (e.g., +5% voltage from the nominal (N) voltage) across the high-voltage outer coil 114 by enabling current flow through first portion 114A, the second portion 114B, and the third portion 114C of the high-voltage outer coil 114. Other incremental changes in voltage may be accomplished by choosing larger or small portions for the second portion 114B and third portion 114C. Furthermore, other numbers of taps 234 can be used. For example, a 5 voltage level adjustment (e.g., −5%, −2.5%, normal (N), +2.5%, and +5%) can be achieved using 6 taps.

Again referring to FIG. 2C, the tap changer assembly 132 includes a first molding 236 including the multiple taps 234 (e.g., 4 taps in the disclosed embodiment). The multiple taps 234 can be contained in a tap cavity 238 of the first molding 236. The first molding 236 can be molded about the high-voltage outer coil 114 by any suitable molding process, such as vacuum molding, injection molding, and the like using a suitable mold having the desired final outer dimensions ensuring suitable insulation about the high-voltage outer coil 114. Taps 234 may be positioned and held in place using threaded inserts during molding or casting in a mold, for example.

One especially suited process is vacuum resin casting. During resin casting, a vacuum may applied to a mold inlet, such as an upper inlet, while resin is provided to another mold inlet, such as the lower inlet. Application of vacuum withdraws air from any area that will receive insulation and prevents the formation of air bubbles as the resin fills the intended area. Formation of air bubbles may result in electrical discharge when the high-voltage outer coil 114 is energized. Insulation insertion and/or removal processes are described, for example, in U.S. Patent Application Publication No. US 2014/0118101 A1, which is hereby incorporated by reference herein in its entirety for all purposes. In some embodiments, the first molding 236 may be formed from an epoxy resin, polyurethane, polyester, silicone, or the like. Other suitable insulating materials may be employed. Example resins can include, for example, ARADUR® HY 926 CH and/or Araldite® CY 5948 available from Huntsman Quimica Brasil Ltda. of Sao Paulo, Brazil.

The tap changer assembly 132 further includes a semi-conductive coating 240 applied to an outer surface 242 of the first molding 236. In particular, the entire outer surface of the first molding 236 can be painted with the semi-conductive coating 240. The semi-conductive coating 240 can be a semi-conductive paint. Semi-conductive coating 240 has an electrical resistivity at room temperature of greater than or equal to 500 Ohm/□ and lower than or equal to 20,000 Ohm/□ in some embodiments. Electrical resistivity at room temperature is measured per DIN EN 62631-3-2.

Example semi-conductive coatings 240 can be made from an epoxy material including a conductive pigment, or a polyester or polyurethane resin with mineral loading, such as coal, for example. Other suitable semi-conductive coating materials can be used.

The semi-conductive coating 240 may include a coating thickness of between about 30 microns and 500 microns, or even between 30 microns and 200 microns, for example.

Other suitable thicknesses can be used. Semi-conductive coating 240 may be applied by any suitable process, such as bush, rolling, spraying, and dipping. Semi-conductive coating 240 may be applied over the entire surface of the first molding 236, but should not be applied to the terminals.

The tap changer assembly 132 further includes a conductive shield 244 provided adjacent to and preferably in electrical contact with the semi-conductive coating 240. The conductive shield 244 can be an electrically-conductive metal sheet, film, foil, mesh, and the like. The conductive shield 244 can be a conductive metal, such as stainless steel, aluminum, copper, and the like. The conductive shield 244 should be highly electrically conductive. For example, the conductive shield 244 should have an electrical conductivity of greater than or equal to $1.0\times10^3$ S/m, and greater than or equal to $1.0\times10^5$ S/m in some embodiments. Conducting shield 244 is applied to the cylindrical outside portions of the coil 114, to the respective upper and lower ends of the coil 114, to the cylindrical inner portion of the coil 114, to the columnar extension 126*e*, and at least to the sides of portion of the first molding 236 of the tap changer assembly 132. Thickness of the conductive shielding 244 can be between about 0.01 mm and 2 mm, or between about 0.05 mm and 0.2 mm in some embodiments, for example. Other suitable thicknesses can be used. In some embodiments the conductive shielding 244 can include perforations or other suitable void patterns thereon to allow casting material to leave no void between the first molding 236 and the second molding 252 during molding/casting. Further, the perforations or void patterns can improve mechanical fixation between conductive shielding 244 and the surrounding casting material, and may also improve expansion capability due to warming and cooling of the high-voltage outer coil 114 in operation. In terms of function, the conductive shield 244 should have an electrical resistance of less than or equal to 5 Ohm measured per IEEE C57.12.91 between any location on the conductive shielding 244 and the ground terminal 128.

Figure 2D:
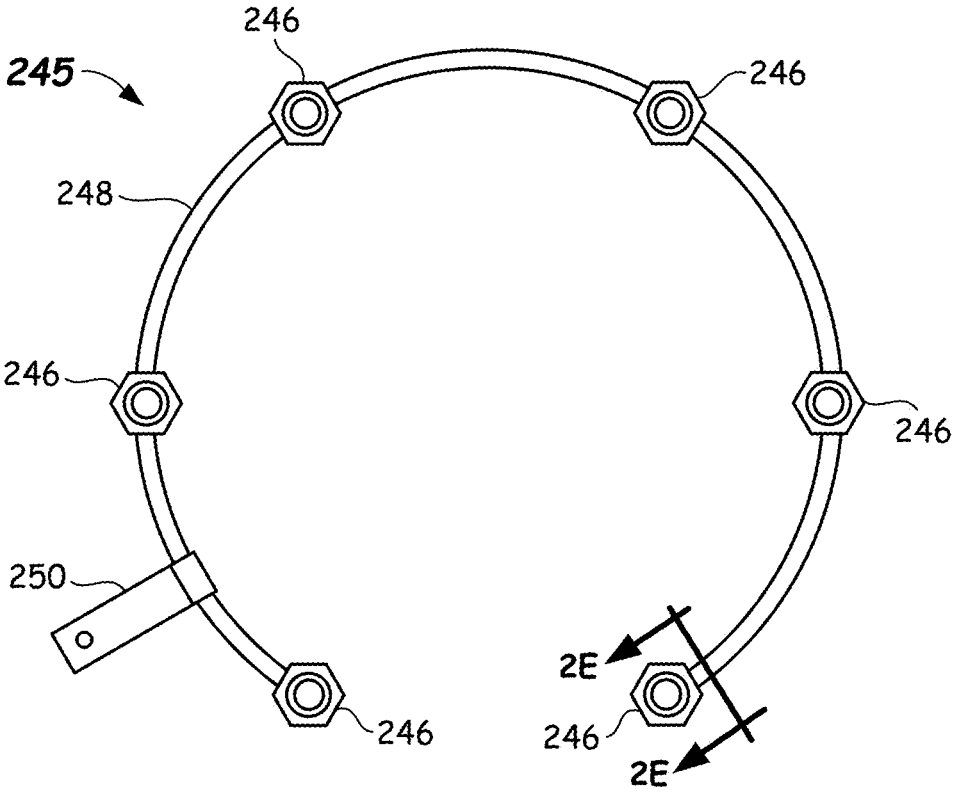
FIG. 2D illustrates a top view of a grounding member having a ring of bosses interconnected by a grounding conductor (wire ring and grounding strap) in accordance with embodiments provided herein.
Figure 2E:
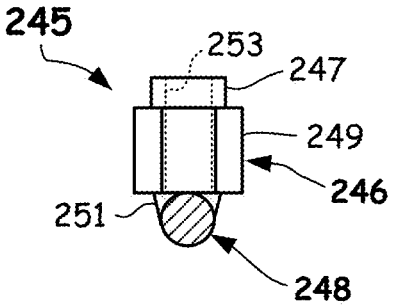
FIG. 2E illustrates a partially cross-sectioned side view of a threaded boss attached to the grounding conductor in accordance with embodiments provided herein.

The tap changer assembly 132 further includes a grounding member 245. Grounding member 245 can be comprised of a ring of bosses 246 interconnected by a grounding conductor 248 as best shown in FIGS. 2D-2E. Six equally-spaced bosses 246 are shown, but more or less can be used. The grounding conductor 248 can be an electrically-conductive metal wire, such as a copper, brass, or aluminum wire having a diameter of between about 0.1 mm and 10 mm, and between about 1 mm and 5 mm in some embodiments, for example. Other dimensions are possible. The metal wire can be provided in the form of a broken ring, which makes it easier to assemble the grounding member 245 in the mold.

The grounding conductor 248 can be connected to a bottom of each of the bosses 246 by fill 251 (e.g., metal fill) formed by braising, soldering, welding, and the like. Fill material 251 can seal the bottom of the threaded passage 253. Bosses 246, as shown in FIG. 2E, can have a head portion 247 that can be cylindrical in shape, i.e., comprising a head portion having a circular shape in transverse cross section, and a body 249 that can be hexagonal in shape, i.e., a bottom portion having a hexagonal shape in transverse cross section, for example. Other shapes are possible.

The head portion 247 can be made smaller than the body 249 so that the second molding 252 can envelop the bosses 246 and retain them in place within the second molding 252. Grounding member 245 can include a grounding interconnector 250. Grounding interconnector 250 can connect between the grounding conductor 248 and the conductive shield 244, and thus ground between the bosses 246 and the conductive shield 244. A connector 254, such as a rivet, crimp, or other mechanical fastener can be used to electrically interconnect the grounding interconnector 250 and the end portion of the conductive shield 244.

Again referring to FIG. 2C, the tap changer assembly 132 further includes a second molding 252 applied over the conductive shield 244 and the grounding member 245. The second molding 252 includes a molded sealing surface 255. The second molding 252 can have a thickness of between about 0.5 mm and 20 mm above the conductive shield 244. Each of the first molding 236 and the second molding 252 can include tapered draft surfaces formed at an angle of about 5 degrees to 20 degrees to aid in removal from the mold. Other draft angles may be employed.

The conductive cover 258 is electrically coupled to the ring of bosses 246, such as by a corresponding ring of fasteners 262. Fasteners can be made from any electrically-conductive and corrosion resistant material such as stainless steel. Conductive cover 258 can be made of a corrosion resistant and electrically-conductive metal, such as brass, stainless steel, or the like. In some embodiments, the same material can be used for the second molding 252 as was for the first molding 236. However, optionally, a different casting material can be considered for the second molding 252. For example, the casting material can be a two-part, heat-activated epoxy, wherein no pressure is applied during the casting process for the second molding 252.

Tap changer assembly 132 further includes a sealing member 256 configured to seal between a molded sealing surface 255 and an undersurface of the conductive cover 258. Sealing member 256 can be of any suitable form and material to provide a water-tight seal. For example, sealing member 256 may be an O-ring seal, made of a silicone material, for example. Optionally, the sealing member can be a flexible gasket, such as a silicone gasket. Other suitable resilient or polymer materials can be used, such as rubber, fluorocarbon elastomer, and the like. The molded sealing surface 255 of the second molding 252 can be an O-ring groove, for example. However, in some embodiment, the molded sealing surface 255 can be a smooth molded surface and an O-ring groove may be cut into the bottom of the conductive cover 258. The conductive cover 258 can further include one or more fill ports 267 that can be used to fill the taps cavity 238 with any suitable non-conductive sealant material, such as a potting compound or encapsulant material. For example, a two-part non-urethane encapsulant can be used.

Submersible dry-type transformers 100 including tap changer assemblies 132 provided in accordance with embodiments described herein may have lower material costs than other transformer designs. For example, the material cost of the sealing surface can be lower than the cost of using metal sealing components. The simplicity of the casting or molding of the molded sealing surface and labor time required for producing the tap changer assembly may also reduce costs.

Figure 3A:
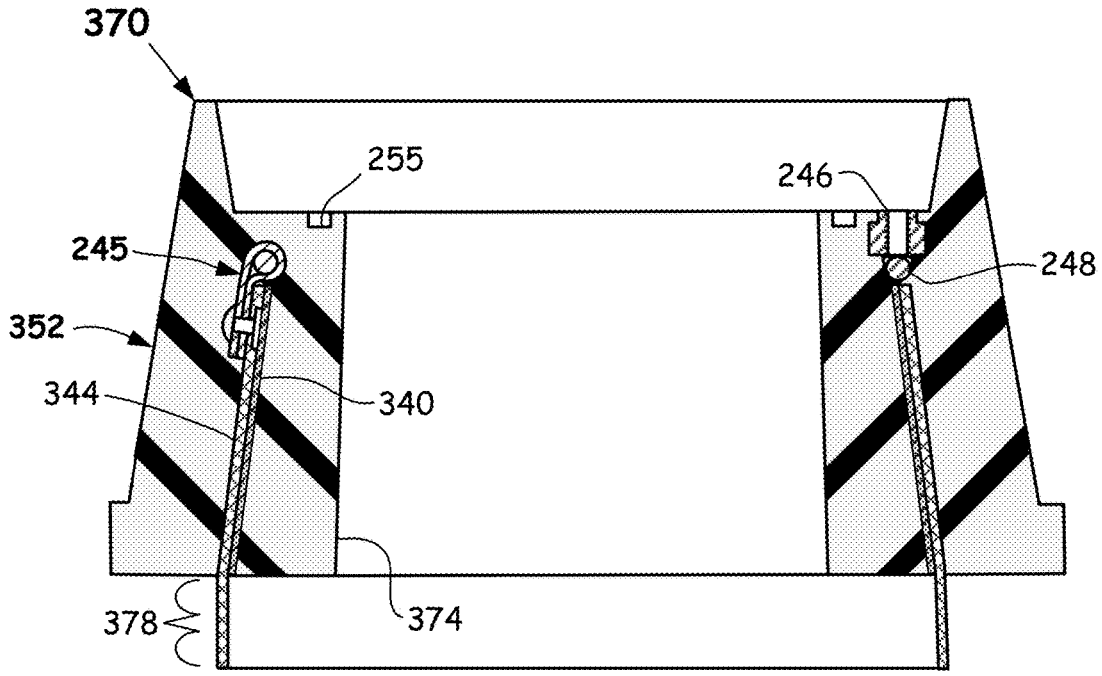
FIG. 3A illustrates a cross-sectioned side view of a separately-molded component of an alternative tap changer assembly in accordance with embodiments provided herein.
Figure 3B:
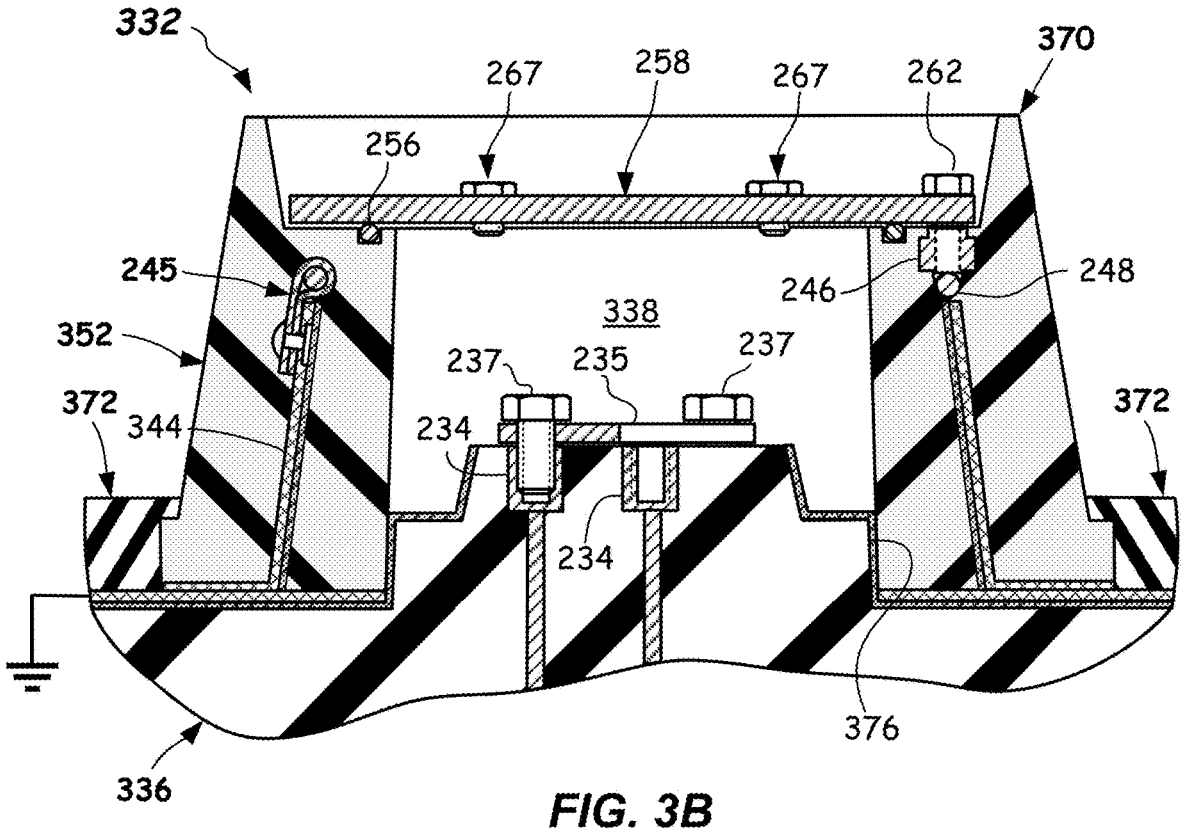
FIG. 3B illustrates a cross-sectioned side view of the alternative tap changer assembly in accordance with embodiments provided herein.

With reference to FIGS. 3A and 3B, an alternative embodiment of a tap changer assembly 332 is shown and described. Components of this tap changer assembly 332 can be molded as a separately-molded member 370 and then combined with the first molding 336. In particular, the grounding member 245 comprising a ring of bosses 246 interconnected by a grounding conductor 248 as shown in FIG. 2D, and the second molding 352 applied over at least a portion of the conductive shield 344 and the grounding conductor 248 comprises the separately-molded member 370. A semi-conductive coating 340 can be applied to the inner surface of the conductive shield prior to molding. The separately-molded member 370 can be molded or cast in a separate process and mold including the contours of the separately-molded member 370 shown, for example. A portion 378 of the conductive shield 344 may not be provided in the mold and may be left unmolded/uncast. The remaining items of FIG. 3A-3B can be the same as discussed above for FIG. 2C.

In the depicted embodiment of FIG. 3B, the tap changer assembly 332 can comprise a third molding 372 applied over at least a portion of the second molding 352 and at least a portion of the first molding 336. As installed, the tap changer assembly 332 can include an opening 374 in the separately-molded member 370 being received over a pilot 376 formed on the first molding 336. Thus, it should be understood that the separately-molded member 370 is molded or cast as a separate piece and is mechanically joined with the first molding 336 in the depicted embodiment. The portion 378 of the conductive shield 344 that is unmolded/uncast, i.e., bare, can be folded over and placed in electrical contact with the portion of the conductive shield on the first molding 336 as the separately-molded member 370 is joined with the first molding 336. The separately-molded member 370 can be held in place against the portion of the conductive shield 344 on the first molding 336 as the third molding 372 is applied. Electrically-conductive grease or an electrically-conductive resin may be applied at the interface of the portion 378 and the conductive shield 344 on the first molding 336.

Figure 5:
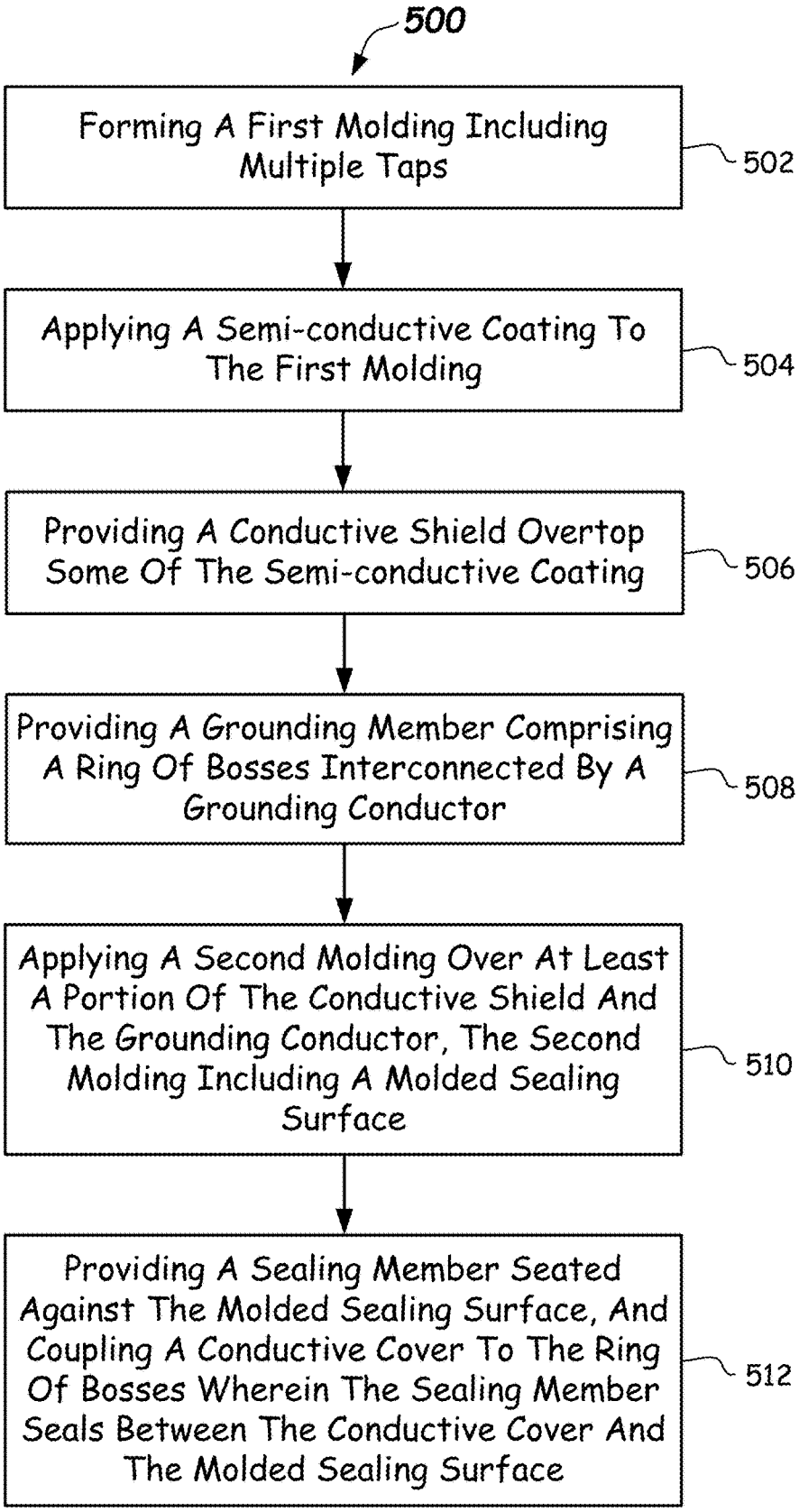
FIG. 5 illustrates a flowchart of a method of manufacturing a tap changer assembly in accordance with embodiments provided herein.

Now referring to FIG. 5, in some embodiments, a method of forming a tap changer assembly (e.g., tap changer assembly 132, 332) of a dry-type transformer (e.g., dry-type transformer 100) is provided. The method 500 includes, in 502, forming a first molding (e.g., first molding 236, 336) including the multiple taps (e.g., taps 234 whose interconnection can control a voltage across the high-voltage outer coil 114). The forming of the first molding 236 can be by vacuum casting, injection molding, and the like and provides the coil housing 126 of an insulating coating all around the high-voltage outer coil 114 and around the sides and bottom of taps 234. The first molding 236 can form the columnar front extension 126E and the extending parts of the high voltage terminals 118, the upper and lower delta terminals 122, 124, and grounding terminal 128.

The method 500 further includes, in 504, applying a semi-conductive coating (e.g., semi-conductive coating 240) to the first molding (e.g., first molding 236, 336). The semi-conductive coating should be applied all over the surface 242 of the first molding 236, 336, except on the terminal connections.

Further, the method 500 includes, in 506, providing a conductive shield (e.g., conductive shield 244) overtop at least some, and preferably a substantial portion of the semi-conductive coating (e.g., semi-conductive coating 240).

Moreover, the method 500 includes, in 508, providing a grounding member (e.g., grounding member 245) comprising a ring of bosses (e.g., bosses 246) interconnected by a grounding conductor (e.g., grounding conductor 248).

The method 500 further includes, in 510, applying a second molding (e.g., second molding 252, 352) over at least a portion of the conductive shield (e.g., conductive shield 244, 344) and the grounding conductor (e.g., grounding conductor 248), wherein the second molding includes the molded sealing surface (e.g., molded sealing surface 255). The portion of the conductive shield 244, 344 covered by the second molding 252 can be at least the portion extending outwardly from the conductive shield portion underneath the columnar front extension 126E.

Additionally, the method 500 can further include, in 512, providing a sealing member (e.g., sealing member 256) seated against the molded sealing surface (e.g., molded sealing surface 255), and coupling (e.g., via conductive fasteners 262) a conductive cover (e.g., conductive cover 258) to the ring of bosses (e.g., bosses 246) wherein the sealing member seals between the conductive cover and the molded sealing surface. The sealing member 256 seals the tap cavity 238, 338.

While the present disclosure is described primarily with regard to submersible dry-type transformers, it will be understood that the disclosed tap changer assemblies may also be employed with other types of transformers or coil assemblies including shielding.

The foregoing description discloses only example embodiments. Modifications of the above-disclosed assemblies and methods which fall within the scope of this disclosure will be readily apparent to those of ordinary skill in the art. For example, although the examples discussed above are illustrated for dry-type transformers, other embodiments in accordance with this disclosure can be implemented for other devices. This disclosure is not intended to limit the invention to the particular assemblies and/or methods disclosed, but, to the contrary, the intention is to cover all modifications, equivalents, and alternatives falling within the scope of the claims.

What is claimed is:

1. A tap changer assembly, comprising:

a first molding including multiple taps;

a semi-conductive coating applied to an outer surface of the first molding;

a conductive shield provided in contact with the semi-conductive coating;

a grounding member comprising a ring of bosses interconnected by a grounding conductor;

a second molding applied over at least a portion of the conductive shield and the grounding conductor, the second molding including a molded sealing surface;

a conductive cover coupled to the ring of bosses; and a sealing member sealing between the molded sealing surface and the conductive cover.

2. The tap changer assembly of claim 1, wherein the grounding member comprises a grounding interconnector coupled to the grounding conductor and configured to attach to the conductive shield.

3. The tap changer assembly of claim 1, wherein the grounding conductor comprises a metal wire.

4. The tap changer assembly of claim 3, wherein the metal wire is connected to a bottom of each of the bosses.

5. The tap changer assembly of claim 4, wherein the metal wire is connected to each of the bosses by braising.

6. The tap changer assembly of claim 4, wherein the metal wire comprises a broken ring.

7. The tap changer assembly of claim 1, wherein the conductive cover is coupled to the ring of bosses by a corresponding ring of fasteners.

8. The tap changer assembly of claim 1, wherein each of the bosses comprise a top portion having a circular shape in transverse cross section, and a bottom portion having a hexagonal shape in transverse cross section.

9. The tap changer assembly of claim 1, wherein the grounding member comprises a grounding interconnector wrapped about the grounding conductor and attach to the conductive shield by a fastener.

10. The tap changer assembly of claim 9, wherein the fastener comprises a rivet.

11. The tap changer assembly of claim 1, wherein the semi-conductive coating has an electrical resistivity at room temperature of greater than or equal to 500 Ohm/□ and lower than or equal to 20,000 Ohm/measured per DIN EN 62631-3-2.

12. The tap changer assembly of claim 1, wherein the conductive shield has an electrical conductivity of greater than $1.0\times10^3$ S/m.

13. The tap changer assembly of claim 1, wherein the molded sealing surface comprises an O-ring groove.

14. The tap changer assembly of claim 1 wherein the grounding member comprises the ring of bosses interconnected by the grounding conductor, and the second molding applied over at least a shield portion of the conductive shield and the grounding conductor comprises a separately-molded member.

15. The tap changer assembly of claim 14 comprising a third molding applied over at least a molding portion of the second molding and at least a molding portion of the first molding.

16. The tap changer assembly of claim 14 wherein the separately-molded member is received over a pilot formed on the first molding.

17. The tap changer assembly of claim 14 wherein the separately-molded member is molded or cast as a separate piece and is mechanically joined to the first molding.

18. The tap changer assembly of claim 17 wherein the separately-molded member comprises a portion of the conductive shield that is unmolded.

19. A dry-type transformer, comprising:

a coil assembly having an inner coil, an outer coil, and a tap changer assembly having multiple taps configured to allow voltage adjustments across the outer coil, the tap changer assembly, comprising:

a first molding including the multiple taps;

a semi-conductive coating applied to an outer surface of the first molding;

a conductive shield provided in contact with the semi-conductive coating;

a grounding member comprising a ring of bosses interconnected by a grounding conductor;

a second molding applied over at least a portion of the conductive shield and the grounding conductor, the second molding including a molded sealing surface;

a conductive cover coupled to the ring of bosses; and a sealing member sealing between the molded sealing surface and the conductive cover.

* * * * *